US007246962B2

(12) United States Patent
James, III et al.

(10) Patent No.: US 7,246,962 B2
(45) Date of Patent: Jul. 24, 2007

(54) EXIT ROLLER SYSTEM FOR AN IMAGING APPARATUS

(75) Inventors: Edmund H. James, III, Lexington, KY (US); Michael A. Marra, III, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/193,640

(22) Filed: Jul. 29, 2005

(65) Prior Publication Data

US 2007/0025796 A1 Feb. 1, 2007

(51) Int. Cl.
*B65H 29/70* (2006.01)
*B65H 29/20* (2006.01)

(52) U.S. Cl. ..... 400/636; 400/637; 347/104; 271/188

(58) Field of Classification Search ..... 400/641, 400/636, 637, 637.3, 639; 347/104; 271/188, 271/209; 346/143
See application file for complete search history.

(56) References Cited

U.S. PATENT DOCUMENTS

| | | | | |
|---|---|---|---|---|
| 197,477 | A | 7/1877 | Kneeland | |
| 2,381,430 | A | 8/1945 | Belluche | |
| 3,954,261 | A | 5/1976 | Greene et al. | |
| 4,662,626 | A | 5/1987 | Shores et al. | |
| 4,822,024 | A | 4/1989 | Takahashi | |
| 4,934,687 | A | 6/1990 | Hayden et al. | |
| 4,964,627 | A | 10/1990 | Watts et al. | |
| 5,890,822 | A | 4/1999 | Saikawa et al. | |
| 5,975,521 | A | 11/1999 | Ono et al. | |
| 5,980,141 | A * | 11/1999 | Donnis | 400/625 |
| 6,148,727 | A | 11/2000 | Parthasarathy et al. | |
| 6,190,070 | B1 | 2/2001 | Urban et al. | |
| 6,648,469 | B2 * | 11/2003 | Youn | 347/104 |
| 6,701,841 | B2 | 3/2004 | Tsurumaki | |
| 6,793,216 | B2 | 9/2004 | Nakamura | |

FOREIGN PATENT DOCUMENTS

| | | | |
|---|---|---|---|
| JP | 04064568 | A * | 2/1992 |
| JP | 06255868 | A * | 9/1994 |
| JP | 07061072 | A * | 3/1995 |
| JP | 2000053304 | A * | 2/2000 |
| JP | 2002326755 | A * | 11/2002 |

* cited by examiner

*Primary Examiner*—Leslie J Evanisko
(74) *Attorney, Agent, or Firm*—Taylor & Aust, P.C.

(57) ABSTRACT

An imaging apparatus includes a print engine having a print zone. A print media feed system transports a sheet of print media in a media feed direction along a media feed path through the print zone. The print media feed system includes a plurality of exit rollers positioned across a width of the media feed path. Each of a plurality of pressure rollers engages a respective one of the plurality of exit rollers to define a plurality of exit nips. A support structure mounts the plurality of exit rollers and the plurality of pressure rollers. The support structure positions the plurality of exit nips in an arrangement to define a transverse path across the width of the media feed path in the direction transverse to the media feed direction, the transverse path having a central portion and elevated portions on each side of the central portion.

6 Claims, 9 Drawing Sheets

EXIT ROLLER SYSTEM FOR AN IMAGING APPARATUS

BACKGROUND OF THE INVENTION

1. Field of the Invention

The present invention relates to an imaging apparatus, and more particularly, to an exit roller system for an imaging apparatus.

2. Description of the Related Art

An imaging apparatus, such as a multifunction device or printer, may include an ink jet print engine that forms an image on a sheet of print media, such as paper, by ejecting ink from a plurality of ink jetting nozzles of an ink jet printhead to form a pattern of ink dots on the sheet of print media. Such an ink jet print engine typically includes a reciprocating printhead carrier that transports one or more ink jet printheads across the print medium along a bi-directional scanning path defining a print zone of the printer. Typically, the mid-frame provides media support at or near the print zone. A sheet feeding mechanism is used to advance the print medium sheet in a media feed direction through the print zone between scans in the main scan direction, or after all data intended to be printed with the print medium at a particular stationary position has been completed. One such sheet feed mechanism includes a feed roller, also sometimes referred to as an index roller, and a corresponding pinch roller arrangement located upstream of the print zone, and an exit roller and corresponding pressure roller arrangement, such as a plurality of star wheels, located downstream of the print zone.

A common problem in ink jet printers is the occurrence of print artifacts due to poorly maintained printhead-to-print medium gap. When feeding multiple media types (i.e., plain paper, glossy paper, transparencies, envelopes, etc.) a trade off is often made by increasing this gap to avoid the printhead scraping the paper. This results in increased defects from misdirected nozzles and more poorly formed drops, and places a higher requirement on printhead performance to achieve the desired level of print quality.

SUMMARY OF THE INVENTION

The present invention induces a bend in the media based on the orientation of the exit rollers and the associated pressure rollers, which essentially increases the stiffness of the media along the print zone, which in turn helps to maintain flatness of the media by biasing the media against the mid-frame and thereby aids in maintaining a consistent printhead-to-print medium gap.

The present invention, in one form thereof, is directed to an imaging apparatus for printing on a sheet of print media. The imaging apparatus includes a print engine having a print zone. A print media feed system transports the sheet of print media in a media feed direction along a media feed path through the print zone. The print media feed system includes a plurality of exit rollers positioned across a width of the media feed path in a direction transverse to the media feed direction. A plurality of pressure rollers is provided, with each of the plurality of pressure rollers engaging a respective one of the plurality of exit rollers to define a plurality of exit nips. A support structure mounts the plurality of exit rollers and the plurality of pressure rollers. The support structure positions the plurality of exit nips in an arrangement to define a transverse path across the width of the media feed path in the direction transverse to the media feed direction, the transverse path having a central portion and elevated portions on each side of the central portion.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

The exemplifications set out herein illustrate embodiments of the invention, and such exemplifications are not to be construed as limiting the scope of the invention in any manner.

DETAILED DESCRIPTION OF THE INVENTION

Figure 1:
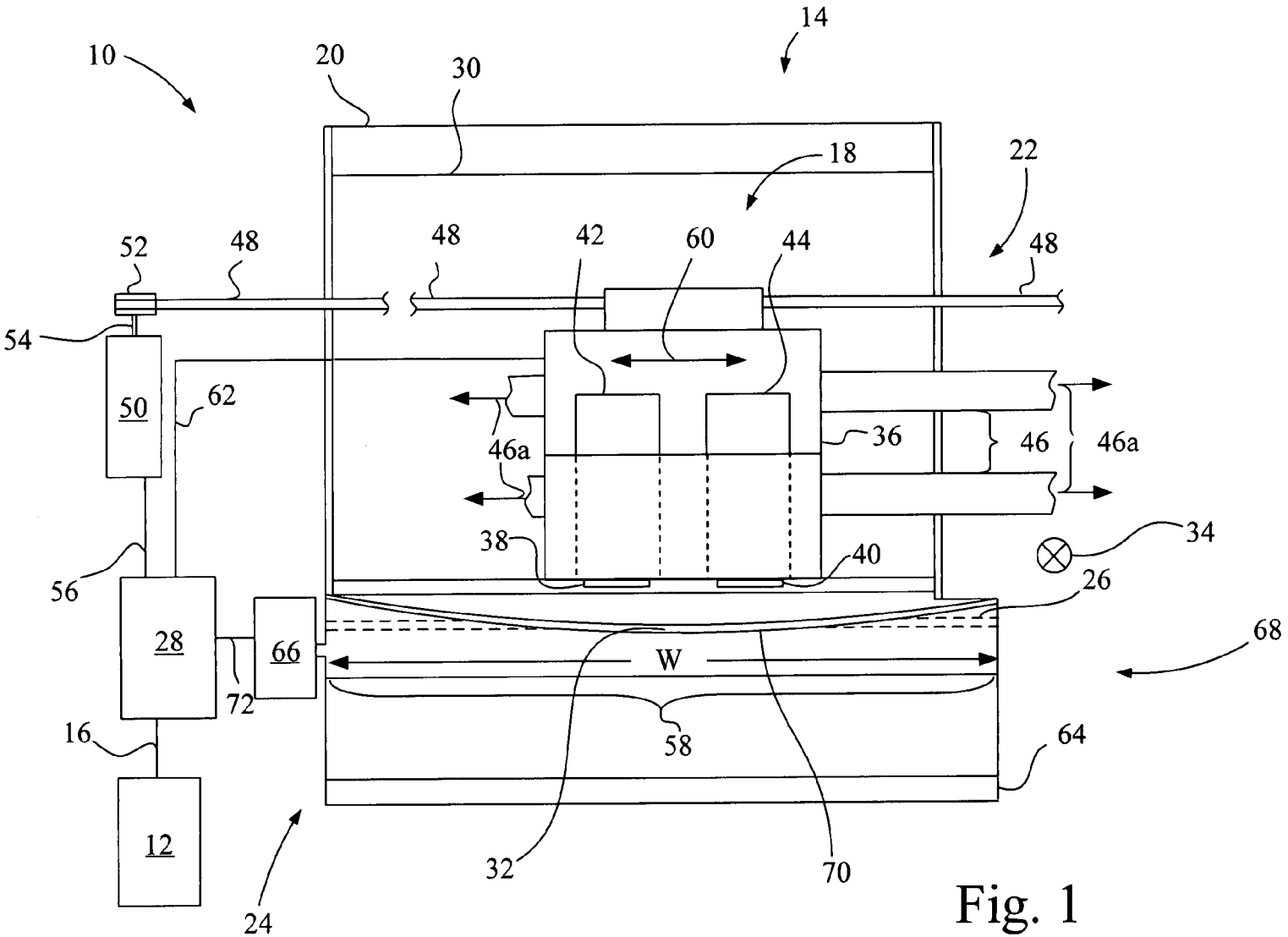
FIG. 1 is a diagrammatic representation of an imaging apparatus embodying the present invention.

Referring now to the drawings, and particularly to FIG. 1, there is shown an imaging system 10 embodying the present invention.

Imaging system 10 includes a host 12 and an imaging apparatus 14. Imaging apparatus 14 may be, for example, an ink jet printer, which in turn may form the print engine for a multi-function device (MFD), such as for example, a standalone unit that has scanning, copying, and/or faxing functionality, in addition to printing functionality. Host 12, which may be optional, may be communicatively coupled to imaging apparatus 14 via a communications link 16.

As used herein, the term "communications link" generally refers to structure that facilitates electronic communication between two components, and may operate using wired or wireless technology. Accordingly, communications link 16 may be, for example, a direct electrical wired connection, a direct wireless connection (e.g., infrared or r.f.), or a network connection (wired or wireless), such as for example, an Ethernet local area network (LAN) or a wireless networking standard, such as IEEE 802.11.

In embodiments including host 12, host 12 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During a printing operation, host 12 includes in its memory a software program including program instructions that function as a printer driver for imaging apparatus 14. The printer driver, for example, includes a halftoning unit and a data formatter that places print data and print commands in a format that can be recognized by imaging apparatus 14.

Imaging apparatus 14 includes a print engine 18 and a print media source 20. Print engine 18 may include, for example, a printhead carrier system 22, a print media feed system 24, a mid-frame 26 (depicted by dashed lines), and a controller 28.

Print media source 20 is configured and arranged to supply an individual sheet of print media 30 to print media feed system 24, which in turn further transports the sheet of print media 30 along a media feed path 32 in a media feed direction 34 across mid-frame 26 during a printing operation. In FIG. 1, media feed direction 34 is shown as an X in a circle to indicate that the direction is out of the plane of the paper toward the reader. Media feed path 32 has a width (W).

Printhead carrier system 22 includes a printhead carrier 36 for carrying, for example, a color printhead 38 and monochrome printhead 40. A color ink reservoir 42 is provided in fluid communication with color printhead 38 and a monochrome ink reservoir 44 is provided in fluid communication with monochrome printhead 40. Reservoirs 42, 44 may be located near respective printheads 38 and 40, which in turn may be assembled as respective unitary cartridges. Alternatively, reservoirs 42, 44 may be located remote from printheads 38, 40, e.g., off-carrier, and reservoirs 42, 44 may be fluidly interconnected to printheads 38, 40, respectively, by fluid conduits.

Printhead carrier 36 is guided by a pair of guide members 46, such as for example, guide rods. Alternatively, one of guide rods could be a guide rail made of a flat material, such as metal. The axes 46*a* of guide rods 46 define a bidirectional-scanning path, also referred to as 46*a*, of printhead carrier 36. Printhead carrier 36 is connected to a carrier transport belt 48 that is driven by a carrier motor 50 by way of a driven carrier pulley 52. Carrier motor 50 has a rotating carrier motor shaft 54 that is attached to carrier pulley 52. Carrier motor 50 is electrically connected to controller 28 via communications link 56. At a directive of controller 28, printhead carrier 36 is transported, in a reciprocating manner, along guide rods 46. Carrier motor 50 may be, for example, a direct current motor or a stepper motor.

The reciprocation of printhead carrier 36 transports ink jet printheads 38 and 40 across the sheet of print media 30 along bi-directional scanning path 46*a* to define a print zone 58 of imaging apparatus 14 as a rectangular region. Mid-frame 26 provides support for the sheet of print media 30 in print zone 58. This reciprocation occurs in a direction 60, e.g., a main scan direction, which is transverse, e.g., orthogonal, to media feed direction 34 and is parallel with bidirectional scanning path 46*a*. Printheads 38 and 40 are electrically connected to controller 28 via a communications link 62.

During each printing pass, i.e., scan, of printhead carrier 36, while ejecting ink from printheads 38 and/or 40, the sheet of print media 30 is held stationary by print media feed system 24. Before ink ejection begins for a subsequent pass, print media feed system 24 conveys the sheet of print media 30 in an incremental, i.e., indexed, fashion to advance the sheet of print media 30 in print zone 58. Following printing, the printed sheet of print media 30 is delivered by print media feed system 24 to a print media exit tray 64.

Print media feed system 24 includes a drive unit 66 coupled to a sheet conveying unit 68, which include exit rollers and corresponding pressure rollers, e.g., star wheels, configured to induce a concave bend 70 in the sheet of print media 30 that is being processed through imaging apparatus 14 in an area downstream of print zone 58, with respect to a media feed direction 34. Drive unit 66 is electrically connected to controller 28 via a communications link 72, and provides a rotational force which is supplied to sheet conveying unit 68. Drive unit 66 includes a motor, such as for example, a direct current (DC) motor, or alternatively, a stepper motor.

Figure 2:
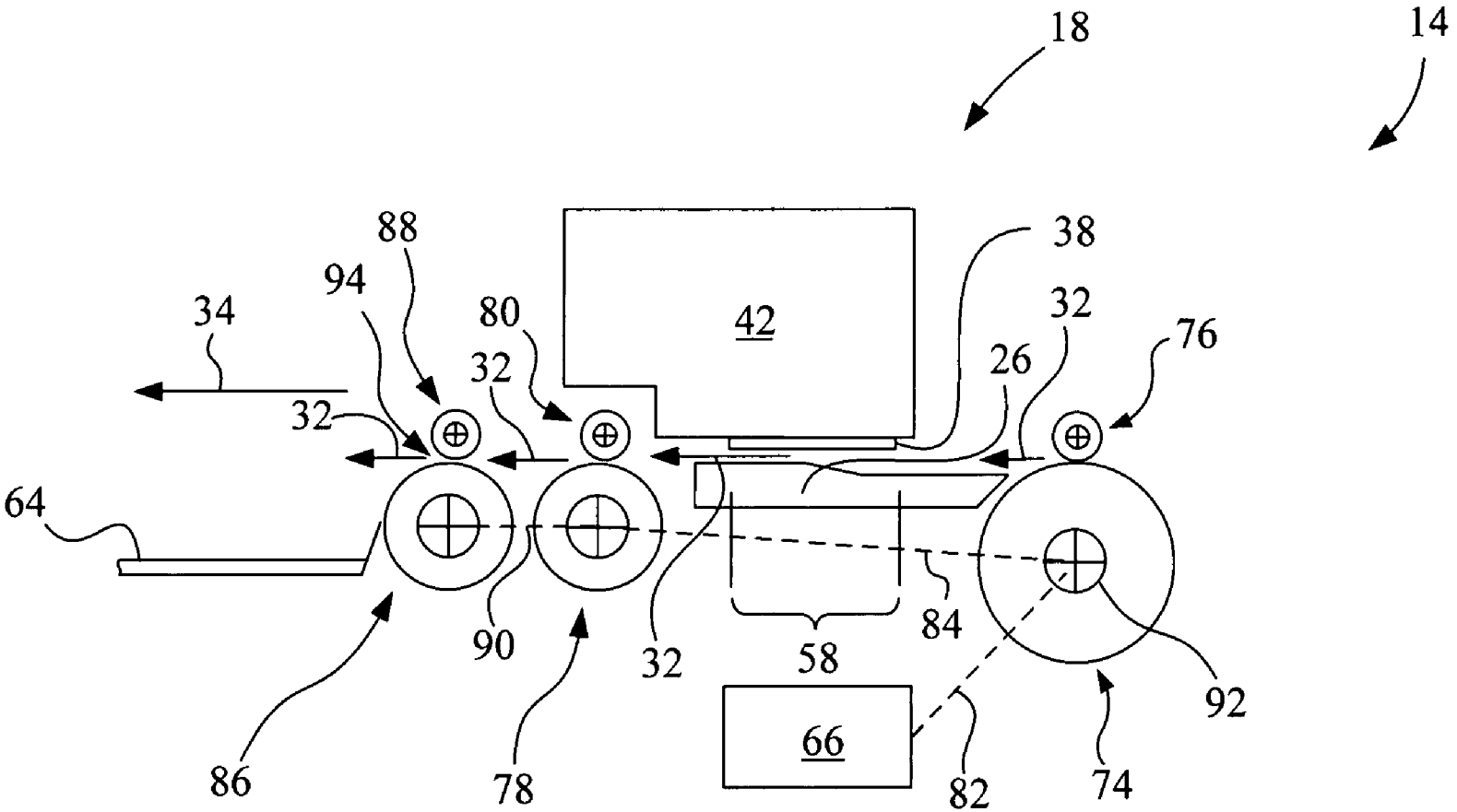
FIG. 2 is a side diagrammatic representation of the print media feed system of the imaging apparatus of FIG. 1.

Referring to FIG. 2, there is shown a diagrammatic representation of a portion of imaging apparatus 14 including sheet conveying unit 68 of print media feed system 24 for conveying the sheet of print media 30 in media feed direction 34. Media feed direction 34 is substantially orthogonal to transverse direction 60, e.g., the main scan direction, and is sometimes referred to in the art as the sub-scan direction.

Sheet conveying unit 68 of print media feed system 24 includes, for example, a set of feed rollers 74, a pinch roller arrangement 76, a first plurality of exit rollers 78, and a first plurality of pressure, i.e., backup, rollers 80. The set of feed rollers 74 is drivably coupled to drive unit 66 via a drive train 82, which is schematically illustrated, and may be for example, a gear train and/or belt arrangement. The set of feed rollers 74 is drivably coupled to some or all of the first plurality of exit rollers 78 via a drive train 84, which is schematically illustrated, and may be for example, a gear train and/or belt arrangement. Pinch roller arrangement 76 may include a plurality of cylindrical rollers.

Some embodiments of the present invention may further include a second plurality of exit rollers 86 and a second plurality of pressure, i.e., backup, rollers 88. In such an embodiment, some or all of the second plurality of exit rollers 86 may be drivably coupled to the first plurality of exit rollers 78 via a drive train 90, which is schematically illustrated, and may be for example, a gear train and/or belt arrangement. Each of first plurality of pressure rollers 80 and/or the second plurality of pressure rollers 88 may be, for example, a single star wheel, a double star wheel, or a spur wheel.

The set of feed rollers 74 includes a shaft 92, such as a plastic or metal shaft. The set of feed rollers 74 is positioned to convey the sheet of print media 30 in media feed direction 34 through said print zone 58, toward the first plurality of exit rollers 78 and the first plurality of pressure rollers 80. The first plurality of exit rollers 78 and the first plurality of pressure rollers 80 are positioned to convey the sheet of print media 30 in media feed direction 34 through print zone 58 toward exit tray 64.

In embodiments of the present invention that include the second plurality of exit rollers 86 and the second plurality of pressure rollers 88, the first plurality of exit rollers 78 and the first plurality of pressure rollers 80 are positioned to convey the sheet of print media 30 in media feed direction 34 to the second plurality of exit rollers 86 and the second plurality of pressure rollers 88, which in turn further conveys the sheet of print media 30 toward exit tray 64.

Referring to FIGS. 1, 3A-3C and 4A-4C, the present invention induces the concave bend 70 in the sheet of media 30 by the geometric pattern of placement and/or size of the exit rollers, such as the plurality of exit rollers 78 and/or the plurality of exit rollers 86, and the associated pressure rollers. By inducing the concave bend 70 in the sheet of print media 30 in the direction 60 that is transverse to the media feed direction 34 (along the width W of media feed path 32), for example, the stiffness of the sheet of print media 30 is increased in and along print zone 58 in the media feed direction 34, which in turn helps to maintain flatness of the sheet of print media 30 by biasing the sheet of print media 30 against mid-frame 26 and thereby aids in maintaining a consistent printhead-to-print medium gap. In some embodiments of the present invention, the curved geometry of the exit system provides for the more geometric change for wider media (i.e., 8.5×11), and some but less change for narrow media (i.e., 4×6).

The discussion of FIGS. 3A-3C and 4A-4C that follows will use, as an example, the plurality of exit rollers 86 and the associated plurality of pressure rollers 88. However, those skilled in the art will recognize that the arrangement as described may also be applied to an exit roller configuration that includes the plurality of exit rollers 78 and the plurality of pressure rollers 80, if desired, alone or in combination with the plurality of exit rollers 86 and the plurality of pressure rollers 88.

In each of the embodiments of 3A-3C and 4A-4C, in the absence of the sheet of print media 30, each pressure roller (88-1, 88-2, 88-3, 88-4, 88-5 and 88-6) of the plurality of pressure rollers 88 engage a respective one (86-1, 86-2, 86-3, 86-4, 86-5, 86-6) of said plurality of exit rollers 86 to define a plurality of exit nips 94, individually identified as 94-1, 94-2, 94-3, 94-4, 94-5, and 94-6. A support structure 96, which may be unitary or formed by multiple structures, is provided for mounting the plurality of exit rollers 86 and the plurality of pressure rollers 88. Support structure 96 positions the plurality of exit nips 94 in an arrangement to define a transverse path 98, e.g., bent path, that corresponding to concave bend 70 shown in FIG. 1, that traverses across said width (W) of media feed path 32 in the direction 60 that is transverse to media feed direction 34. Transverse path 98 has a central portion 100, and has elevated portions 102 and 104, respectively, located on each side of said central portion 100.

Figure 3A:
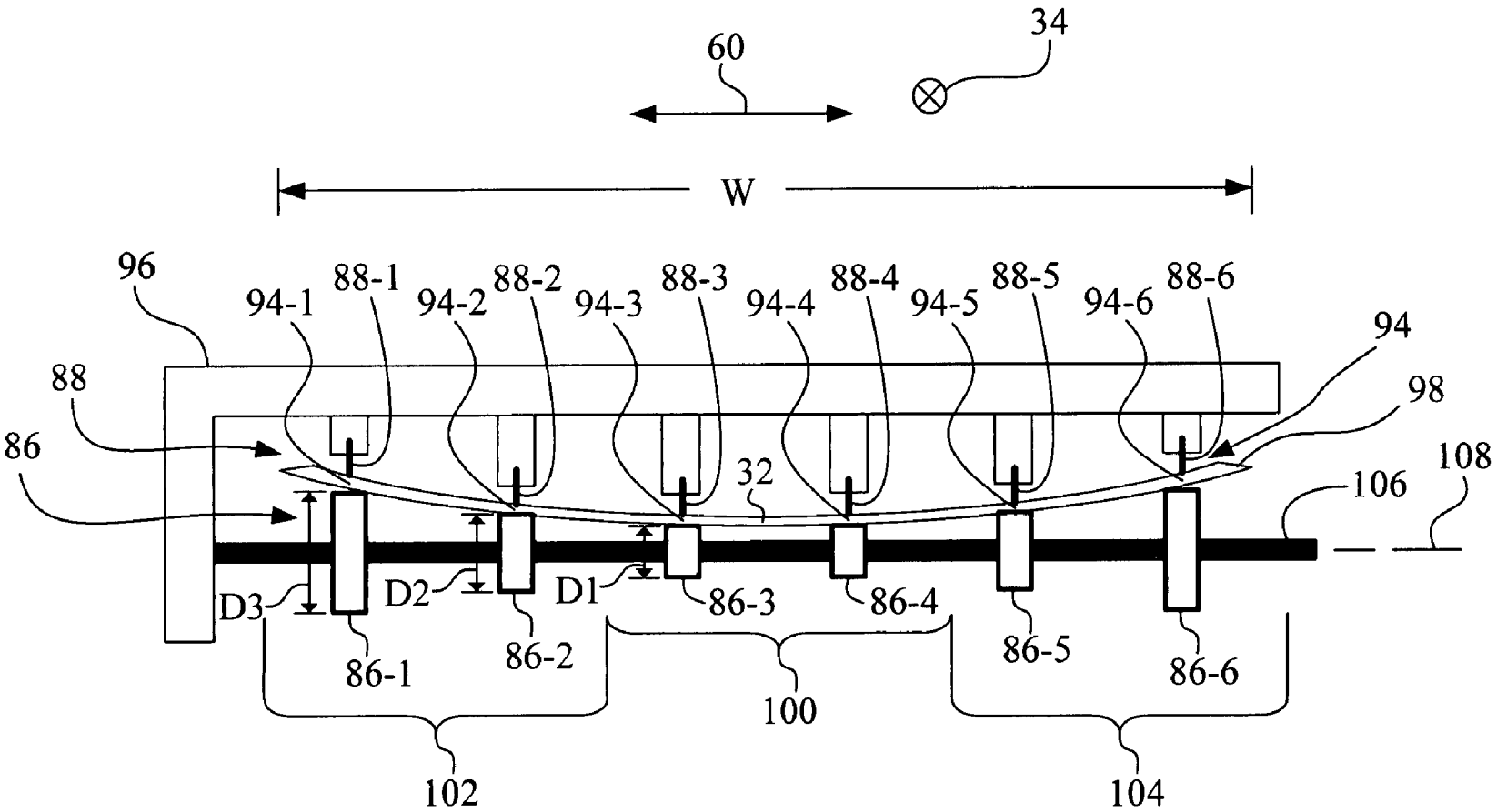
FIG. 3A is a diagrammatic depiction of an arrangement of a plurality of exit rollers and a plurality of pressure rollers in accordance with an embodiment of the present invention.
Figure 3B:
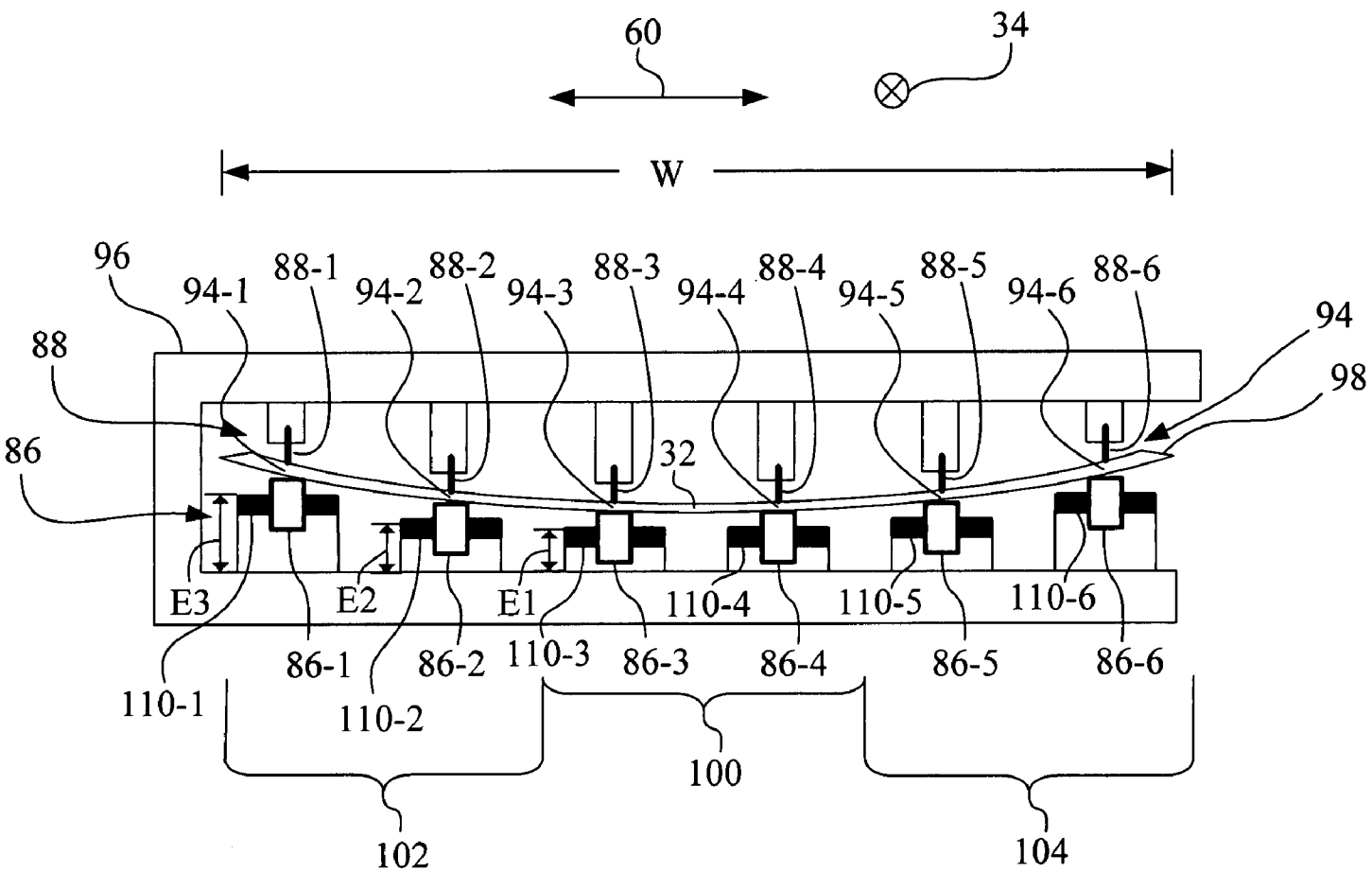
FIG. 3B is a diagrammatic depiction of an arrangement of a plurality of exit rollers and a plurality of pressure rollers in accordance with another embodiment of the present invention.
Figure 3C:
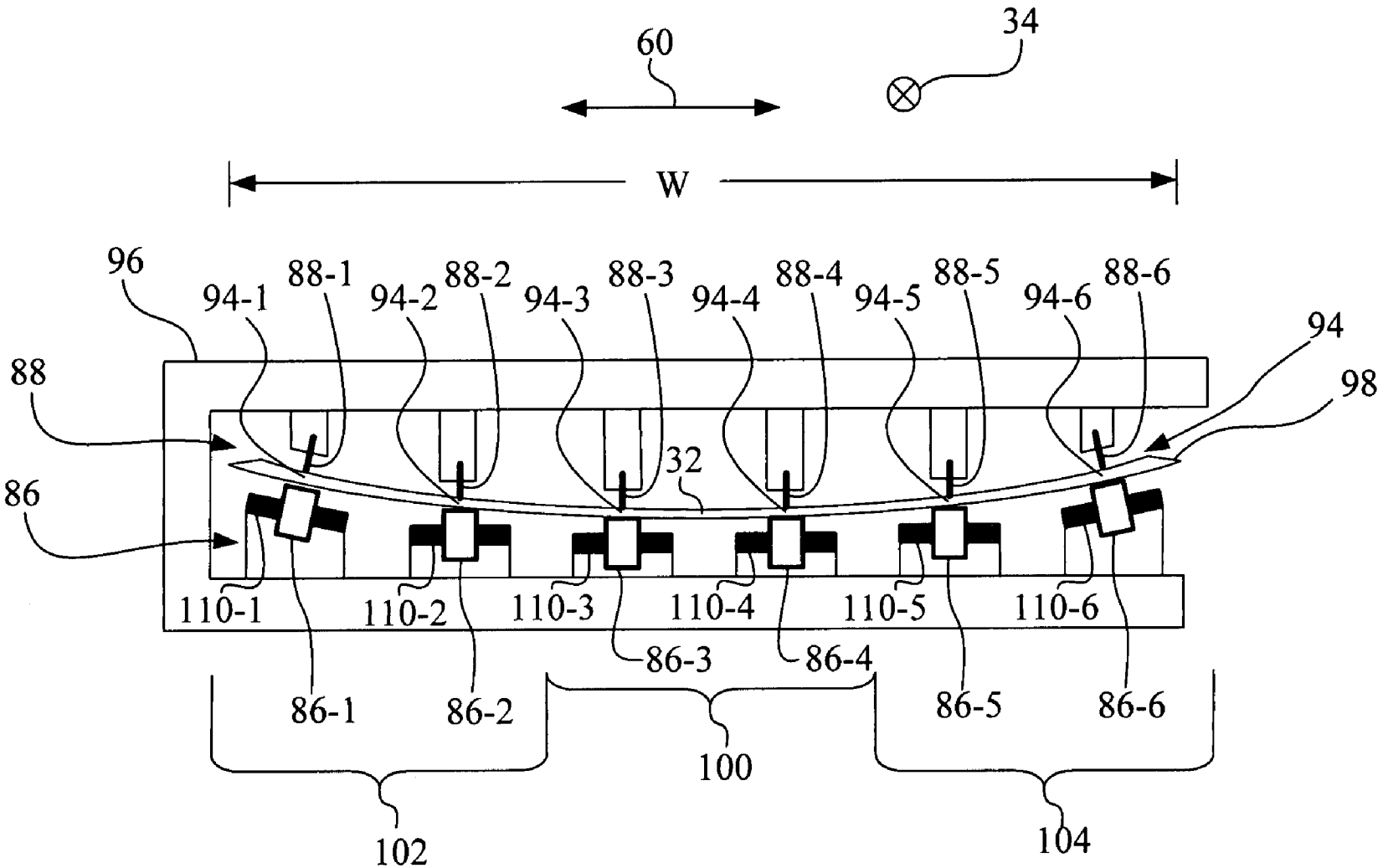
FIG. 3C is a diagrammatic depiction of an arrangement of a plurality of exit rollers and a plurality of pressure rollers in accordance with another embodiment of the present invention.
Figure 4A:
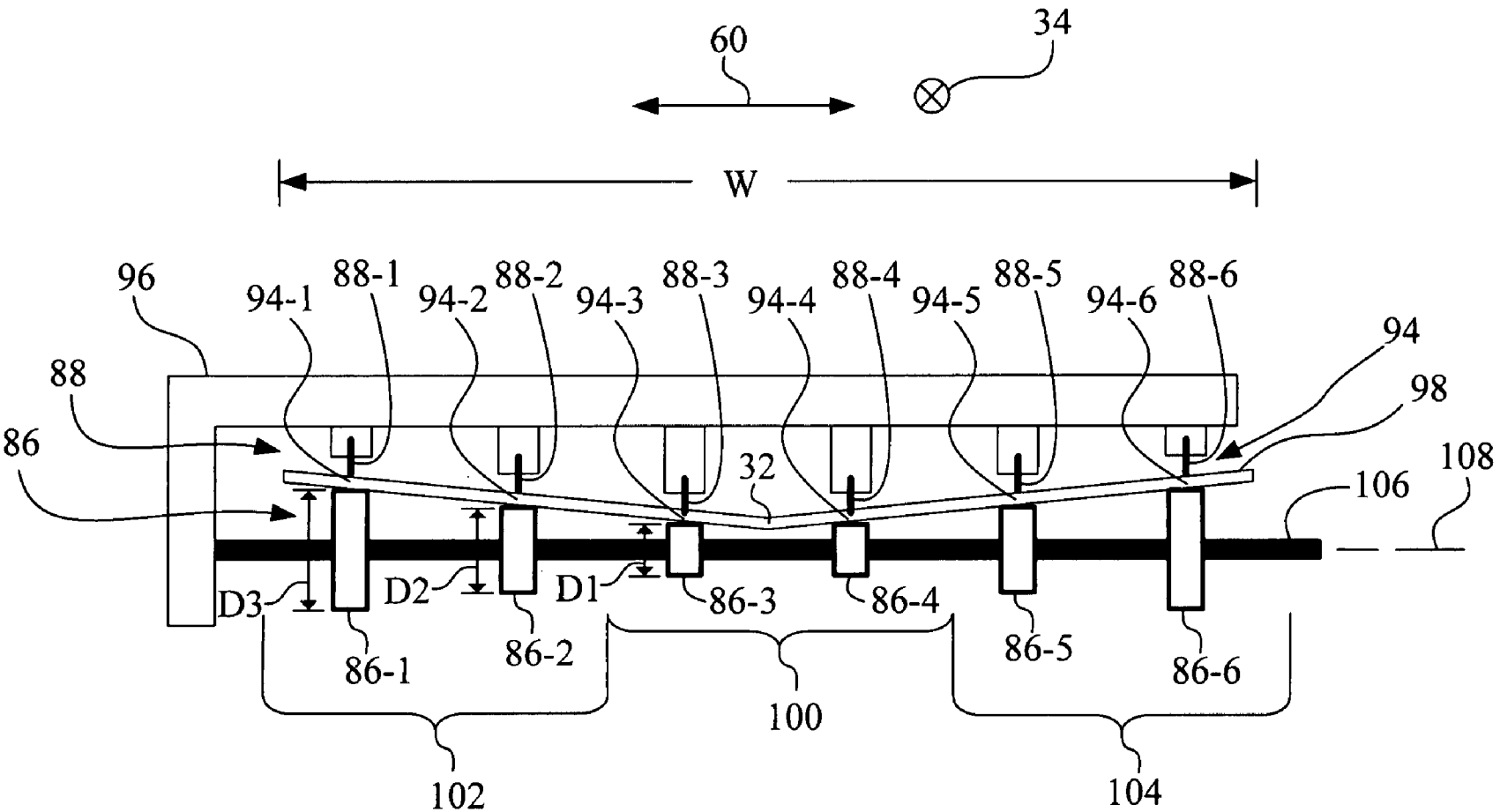
FIG. 4A is a diagrammatic depiction of an arrangement of a plurality of exit rollers and a plurality of pressure rollers in accordance with another embodiment of the present invention.
Figure 4B:
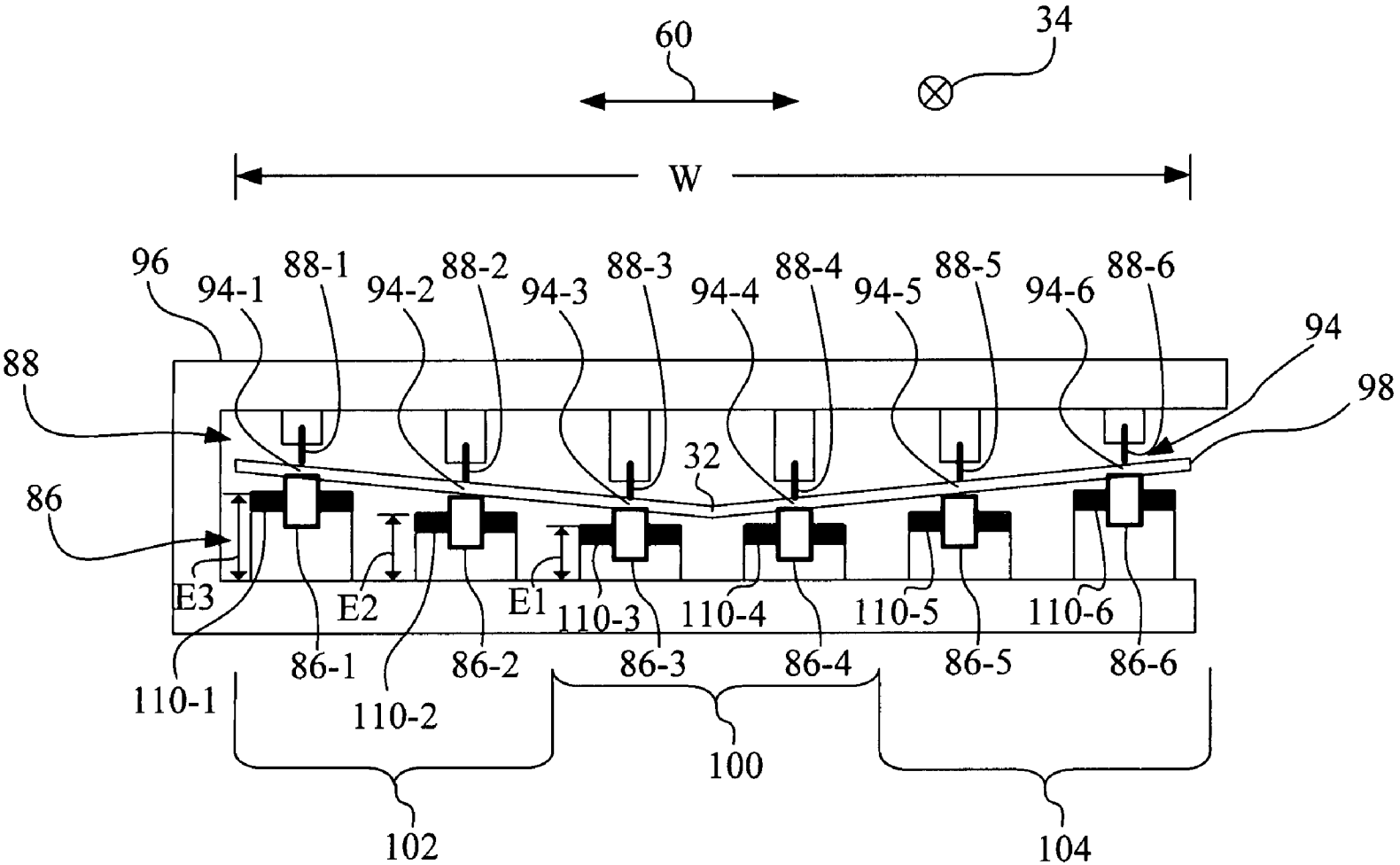
FIG. 4B is a diagrammatic depiction of an arrangement of a plurality of exit rollers and a plurality of pressure rollers in accordance with another embodiment of the present invention.
Figure 4C:
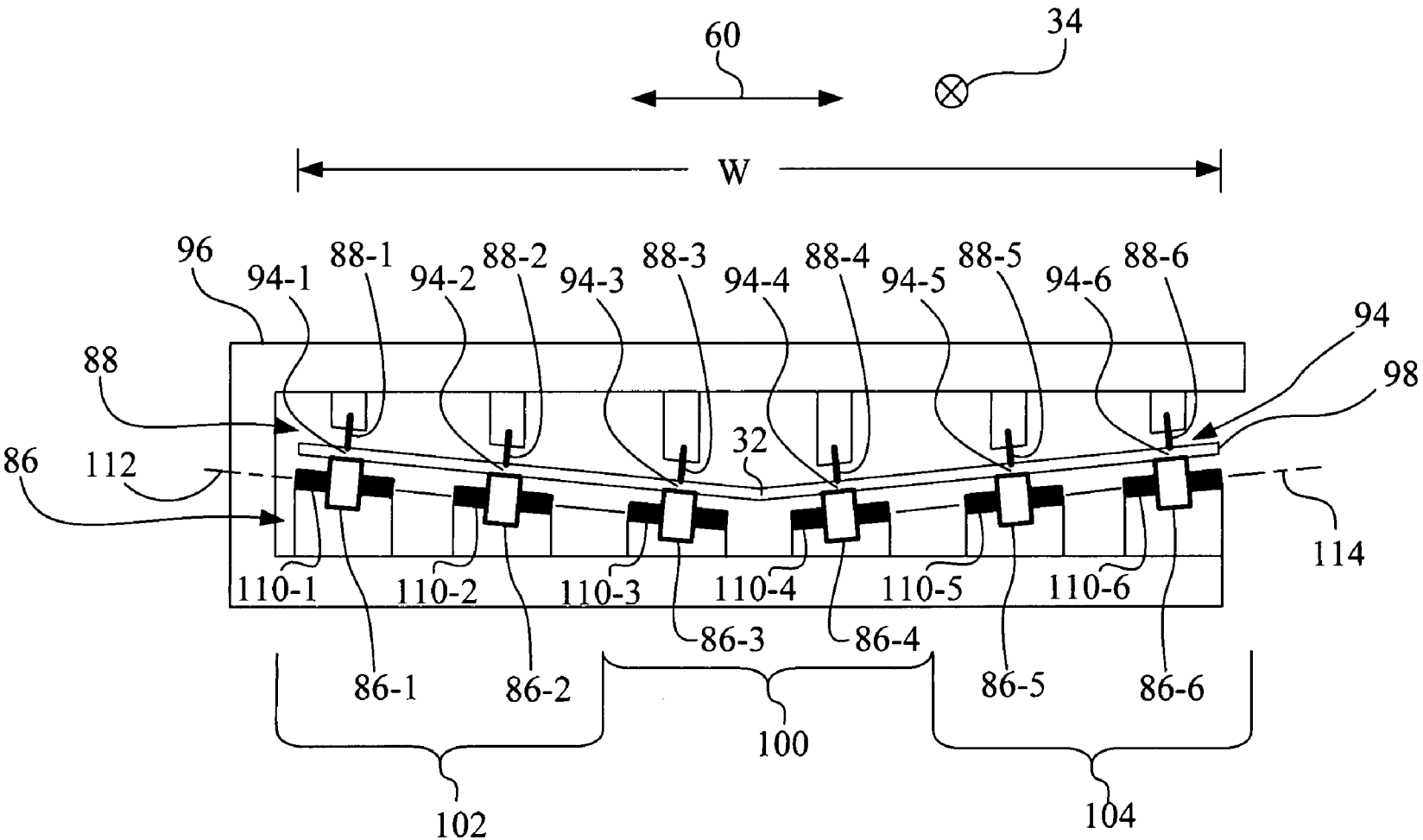
FIG. 4C is a diagrammatic depiction of an arrangement of a plurality of exit rollers and a plurality of pressure rollers in accordance with another embodiment of the present invention.

In the embodiments of FIGS. 3A-3C, transverse path 98 is in the shape of a curved path. In the embodiments of FIGS. 4A-4C, transverse path 98 is in the form of a substantially V-shaped path, defined by two linear segments.

Referring now to the embodiment of FIG. 3A, the plurality of exit rollers 86 are arranged on a common shaft 106 having a rotational axis 108. In this embodiment, the plurality of exit rollers 86 are positioned across the width W of the media feed path 32 and have progressively larger diameters outward from central portion 100. For example, the diameters of exit rollers 86-3 and 86-4 may have a diameter D1. Exit rollers 86-2 and 86-5 may have a diameter D2 that is larger than diameter D1. Exit rollers 86-1 and 86-6 may have a diameter D3 that is larger than diameter D2.

Referring now to the embodiment of FIG. 3B, each of the plurality of exit rollers 86 are of the same diameter. Also, each of the plurality of exit rollers 86 has a separate rotational axis 110-1, 110-2, 110-3, 110-4, 110-5, and 110-6. Support structure 96 positions rotational axes 110-1, 110-2, 110-3, 110-4, 110-5, and 110-6 to be parallel, with some of the rotational axes at different elevations. For example, exit rollers 86-3 and 86-4 may have an elevation E1. Exit rollers 86-2 and 86-5 may have an elevation E2, larger than elevation E1. Exit rollers 86-1 and 86-6 may have a elevation E3 that is larger than elevation E2.

Referring now to the embodiment of FIG. 3C, each of the plurality of exit rollers 86 are of the same diameter. Also, each of the plurality of exit rollers 86 has a separate rotational axis 110-1, 110-2, 110-3, 110-4, 110-5, and 110-6. Support structure 96 positions rotational axes 110-2, 110-3, 110-4, and 110-5 to be parallel, with some of the rotational axes at different elevations. Support structure 96 positions rotational axes 110-1 and 110-6 of exit rollers 86-1 and 86-6 to be canted inwardly toward central portion 100.

Referring now to the embodiment of FIG. 4A, the plurality of exit rollers 86 are arranged on a common shaft 106 having a rotational axis 108. In this embodiment, the plurality of exit rollers 86 are positioned across the width W of the media feed path 32 and have progressively larger diameters outward from central portion 100. For example, the diameters of exit rollers 86-3 and 86-4 may have a diameter D1. Exit rollers 86-2 and 86-5 may have a diameter D2 that is larger than diameter D1. Exit rollers 86-1 and 86-6 may have a diameter D3 that is larger than diameter D2.

Referring now to the embodiment of FIG. 4B, each of the plurality of exit rollers 86 are of the same diameter. Also, each of the plurality of exit rollers 86 has a separate rotational axis 110-1, 110-2, 110-3, 110-4, 110-5, and 110-6. Support structure 96 positions rotational axes 110-1, 110-2, 110-3, 110-4, 110-5, and 110-6 to be parallel, with some of the rotational axes at different elevations. For example, exit rollers 86-3 and 86-4 may have an elevation E1. Exit rollers 86-2 and 86-5 may have an elevation E2, larger than elevation E1. Exit rollers 86-1 and 86-6 may have a elevation E3 that is larger than elevation E2.

Referring now to the embodiment of FIG. 4C, each of the plurality of exit rollers 86 are of the same diameter. Also, each of the plurality of exit rollers 86 has a separate rotational axis 110-1, 110-2, 110-3, 110-4, 110-5, and 110-6. Support structure 96 positions rotational axes 110-1, 110-2, 110-3 along a first common rotational axis 112 that is canted inwardly toward central portion 100, and positions rotational axes 110-4, 110-5 and 110-6 along a second common rotational axis 114 that is canted inwardly toward central portion 100, to form the substantially V-shaped configuration. The outer exit rollers 86-1 and 86-6, for example, are at a higher elevation than exit rollers 86-2, 86-3, 86-4 and 86-5. The exit rollers 86-2 and 86-5, for example, are at a higher elevation than exit rollers 86-3 and. 86-4.

Figure 4D:
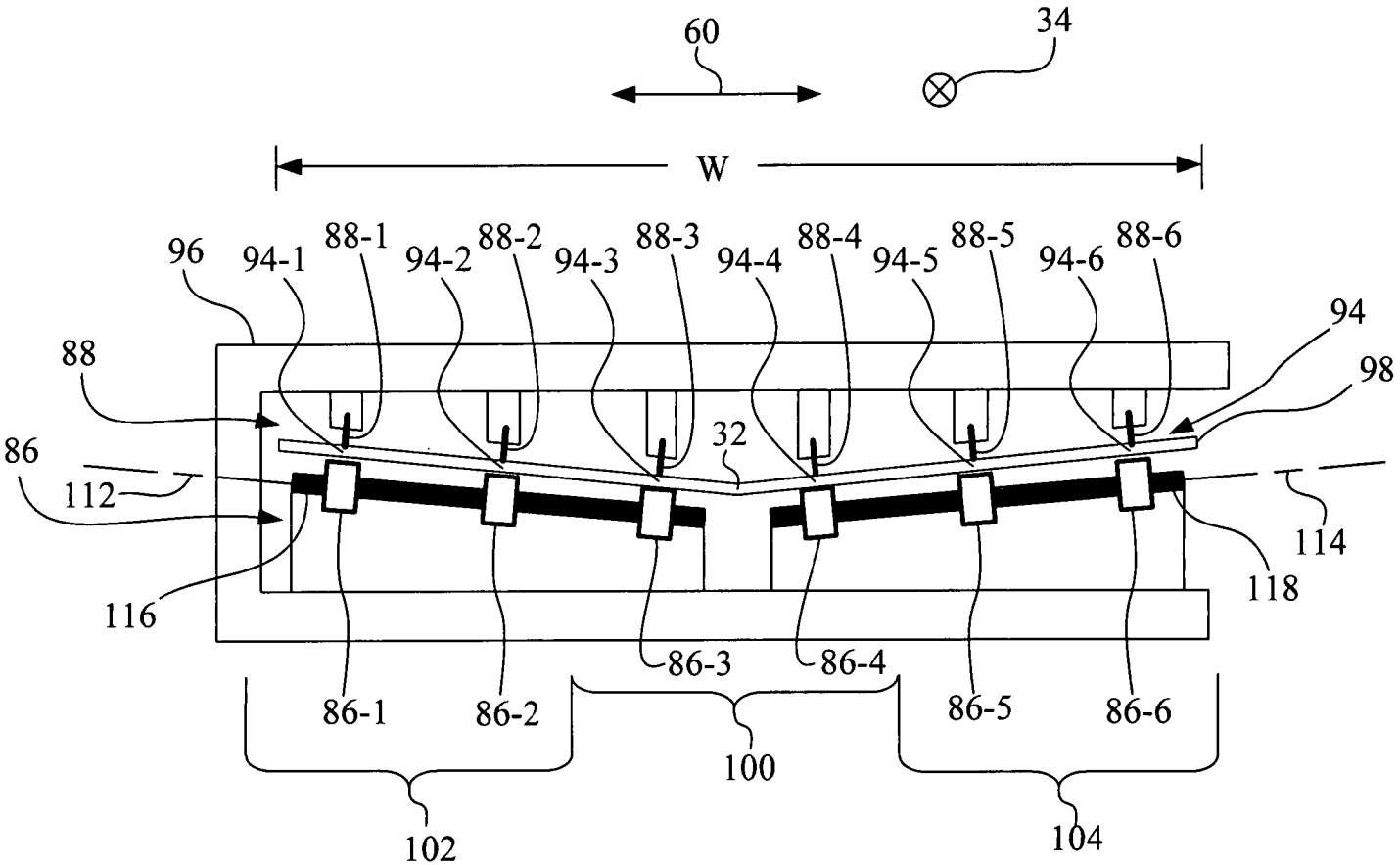
FIG. 4D is a diagrammatic depiction of an arrangement of a plurality of exit rollers and a plurality of pressure rollers in accordance with another embodiment of the present invention.

Referring now to the embodiment of FIG. 4D, each of the plurality of exit rollers 86 are of the same diameter. Exit rollers 86-1, 86-2, 86-3 are mounted on a first shaft 116, and each of exit rollers 86-4, 86-5, and 86-6 are mounted on a second shaft 118. Support structure 96 positions first shaft 116 along the first common rotational axis 112 that is canted inwardly toward central portion 100, and positions second shaft 118 along a second common rotational axis 114 that is canted inwardly toward central portion 100, to form the substantially V-shaped configuration.

While this invention has been described with respect to exemplary embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus for printing on a sheet of print media, comprising:

a print engine having a print zone;

print media feed system to transport said sheet of print media in a media feed direction along a media feed path through said print zone, said print media feed system including:

a plurality of exit rollers positioned across a width of said media feed path in a direction transverse to said media feed direction, said plurality of exit rollers including a first exit roller having a first rotational axis, a second exit roller having a second rotational axis, a third exit roller having a third rotational axis and a fourth exit roller having a fourth rotational axis, wherein in said direction transverse to said media feed direction, said first exit roller and said fourth exit roller form outermost exit rollers of said plurality of exit rollers, and said second exit roller and said third exit roller form interior exit rollers of said plurality of exit rollers, wherein said second rotational axis and said third rotational axis are parallel, said first rotational axis being canted with respect to said second rotational axis, and said fourth rotational axis being canted with respect to said third rotational axis, with said first rotational axis and said fourth rotational axis being non-parallel;

a plurality of pressure rollers, each of said plurality of pressure rollers engaging a respective one of said plurality of exit rollers to define a plurality of exit nips; and a support structure for mounting said plurality of exit rollers and said plurality of pressure rollers, said support structure positioning said plurality of exit nips in an arrangement to define a transverse path across said width of said media feed path in said direction transverse to said media feed direction, said transverse path having a central portion and elevated portions on each side of said central portion.

2. The imaging apparatus of claim 1, wherein said transverse path is a curved path.

3. The imaging apparatus of claim 1, wherein said plurality of exit rollers are positioned downstream of an upstream plurality of exit rollers with respect to said media feed direction.

4. The imaging apparatus of claim 1, said arrangement of said plurality of exit nips forcing said sheet of print media to bend in a direction across a width of said media feed path to stiffen said sheet of print media in said media fed direction.

5. The imaging apparatus of claim 1, further comprising a mid-frame positioned to provide support for said sheet of print media in said print zone, said arrangement of said plurality of exit nips forcing said sheet of print media into contact with said mid-frame.

6. The imaging apparatus of claim 1, wherein said support structure includes multiple supports.

* * * * *